US005859410A

United States Patent [19]

White et al.

[11] Patent Number: 5,859,410

[45] Date of Patent: Jan. 12, 1999

[54] MOUNTING SYSTEM FOR RADIANT COOKTOP HEATING ELEMENTS

[75] Inventors: James Aaron White, Louisville; Jeffery Donald Hunt, Shelbyville, both of Ky.

[73] Assignee: General Electric Company, Louisville, Ky.

[21] Appl. No.: 827,902

[22] Filed: Apr. 7, 1997

[51] Int. Cl.[6] ..... H05B 3/68

[52] U.S. Cl. ..... 219/464; 219/467

[58] Field of Search ..... 219/458, 463, 219/464, 465, 466, 467; 126/211, 214 A, 212, 220, 92 A, 39 H, 39 B

[56] References Cited

U.S. PATENT DOCUMENTS

| | | | |
|---|---|---|---|
| 2,727,133 | 12/1955 | Scofield | 219/464 |
| 2,813,188 | 11/1957 | Hoeflich | 219/464 |
| 2,994,317 | 8/1961 | More | 219/464 |
| 3,613,177 | 10/1971 | Davis . | |
| 3,632,983 | 1/1972 | Dills . | |
| 3,789,189 | 1/1974 | Fischer et al. . | |
| 3,987,275 | 10/1976 | Hurko . | |
| 4,032,750 | 6/1977 | Hurko . | |
| 4,150,280 | 4/1979 | Hurko . | |
| 4,264,805 | 4/1981 | Truat . | |
| 4,363,956 | 12/1982 | Scheidler et al. . | |
| 4,778,978 | 10/1988 | Schreder et al. . | |
| 4,788,414 | 11/1988 | Schreder . | |
| 4,900,899 | 2/1990 | Schreder et al. . | |

*Primary Examiner*—Teresa J. Walberg
*Assistant Examiner*—Sam Paik
*Attorney, Agent, or Firm*—H. Neil Houser

[57] ABSTRACT

A range which includes a mounting system for securing the heating element to the range so that the heating element is maintained against an underside surface of the glass plate with a substantially constant force over a broad temperature range is described. In one embodiment, the mounting system includes a first swing leaf spring and a second swing leaf spring for engaging to the cooktop and to the radiant heating element for positioning the radiant heating element within the radiant heating element opening. More particularly, the cooktop includes at least one radiant heating element opening and a rim extending from an underside surface of the cooktop surrounding the radiant heating element opening. The rim includes a first slot and a second slot, and the first and second slots are located approximately about one hundred and eighty degrees apart in the rim. The first swing leaf spring has a spring hook portion at least partially inserted into the first rim slot, and the second swing leaf spring includes a spring hook portion at least partially inserted into the second rim slot. Each swing leaf spring also includes a lead-in portion for engaging to the heating element. Specifically the lead-in portion includes a spring barb for inserting into a slot in the heating element and an angular offset section for facilitating engagement between the spring and the heating element. Each swing leaf spring also includes an extension portion which, in one embodiment, is u-shaped.

18 Claims, 1 Drawing Sheet

MOUNTING SYSTEM FOR RADIANT COOKTOP HEATING ELEMENTS

FIELD OF THE INVENTION

This invention relates generally to ranges including radiant cooktop heating elements and, more particularly, to a mounting system for mounting the radiant heating elements to the cooktop.

BACKGROUND OF THE INVENTION

In at least some known radiant cooktop ranges, the heating elements are secured to the cooktop below a cooktop glass plate. The heating elements are held against the cooktop glass plate by a mounting assembly including a bracket secured to the range cabinet and a brace which extends the width of the cooktop. The heating elements are mounted to the brace by a compression coil spring and stud assembly. The compression coil spring and stud assembly provides that the heating elements are forced against the cooktop glass plate with a desired force so that heat from the heater elements is efficiently transferred through the glass plate.

In operation, as the heating element heats up, the heat is transferred through the cooktop glass plate to, for example, a cooking bowl located over the heating element on the glass plate. In addition, some heat is transferred to the compression coil spring and stud assembly. For most efficient operation of the heating element described above, it is known that the heating element preferably is forced against the cooktop glass plate at a substantially constant force of about fourteen pounds. As the compression coil spring and stud assembly is heated, however, the force applied by the spring and stud assembly on the heater element may decrease. Of course, when the force of the spring and stud assembly decreases, the heating element may not be forced against the cooktop glass plate at the desired force.

Although the known mounting assembly described above adequately locates and supports the radiant heating elements, such assembly includes numerous parts and is complex to assemble. As a result, assembling the heating elements in the range is time consuming and tedious, which is particularly undesirable in a high volume manufacturing operation.

In addition, and to assemble the mounting assembly described above, tools are used for mounting the bracket to the cooktop, securing the braces to the bracket, and engaging the spring and stud assemblies to the braces and heating elements. The cooktop glass plate, however, is susceptible to scratching, and when using the tools for assembling the mounting assembly, there is a possibility that the glass plate will be scratched by a tool. Of course, scratching the glass plate is highly undesirable since such a scratched plate is more susceptible to breaking than a plate with no scratches.

It would be desirable to provide a mounting system for mounting heating elements to cooktops so that over a wide range of operating temperatures, the heating elements are forced against the cooktop glass plate with a desired force, e.g., fourteen pounds. In addition, it would be desirable for such a system to have a reduced number of parts as compared to known mounting assemblies and to be simple to assemble. Further, it would be desirable to substantially eliminate a need for the use of tools to secure the heating element to the cooktop so as to facilitate avoiding scratching the glass cooktop.

SUMMARY OF THE INVENTION

These and other objects may be attained in a range which includes a mounting system for securing the heating element to the range so that the heating element is maintained against an underside surface of the glass plate with a substantially constant force over a broad temperature range. In one embodiment, the mounting system includes a first swing leaf spring and a second swing leaf spring for engaging to the cooktop and to the radiant heating element for positioning the radiant heating element within the radiant heating element opening.

More particularly, the cooktop includes at least one radiant heating element opening and a rim extending from an underside surface of the cooktop surrounding the radiant heating element opening. The rim includes a first slot and a second slot, and the first and second slots are located approximately about one hundred and eighty degrees apart in the rim. The first swing leaf spring has a spring hook portion at least partially inserted into the first rim slot, and the second swing leaf spring includes a spring hook portion at least partially inserted into the second rim slot.

Each swing leaf spring also includes a lead-in portion for engaging to the heating element. Specifically the lead-in portion includes a spring barb for inserting into a slot in the heating element and an angular offset section for facilitating engagement between the spring and the heating element. Each swing leaf spring also includes an extension portion which, in one embodiment, is u-shaped.

To install the swing leaf springs, each spring is positioned so that the respective spring hooks extends through respective rim slots. Each spring is then rotated so that its offset section contacts the heating element, and each spring is then snapped over the heating element so that its barb is inserted into the slot in the heating element. The swing leaf spring extension portions are extended so that an upward force is imparted by the springs to the heating element.

The above described mounting system secures the heating elements to cooktops so that over a wide range of operating temperatures, the heating elements are forced against the cooktop glass plate with a desired force, e.g., fourteen pounds. In addition, the system has a reduced number of parts as compared to known mounting assemblies and is simple to assemble. Further, the system substantially eliminate a need for the use of tools to secure the heating element to the cooktop so as to facilitate avoiding scratching the glass cooktop.

DETAILED DESCRIPTION OF THE DRAWINGS

Figure 1:
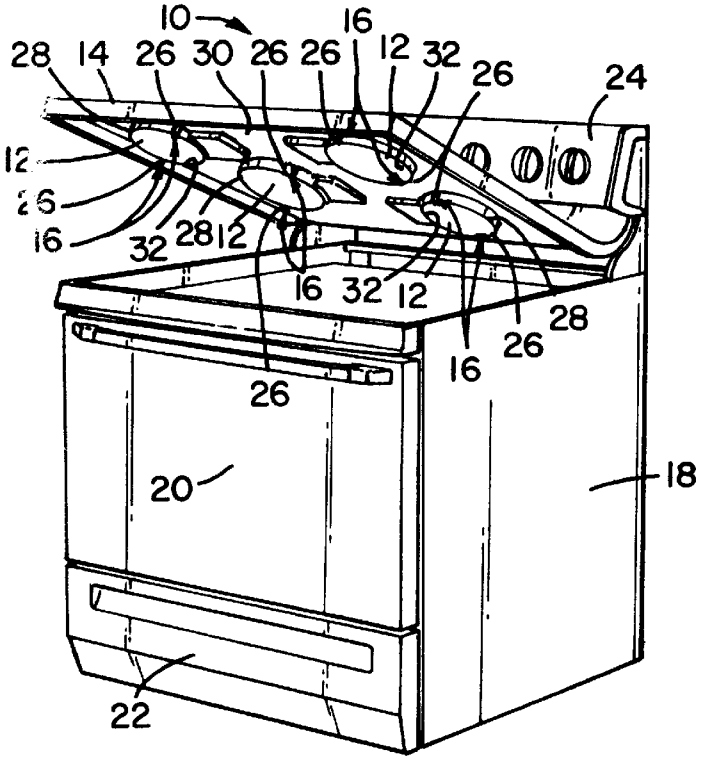
FIG. 1 is a perspective view of a range including radiant heating elements and a mounting system in accordance with one embodiment of the present invention.

FIG. 1 is a perspective view of a radiant cooktop range 10 including heating elements 12 secured to a cooktop 14 by a mounting system 16 in accordance with one embodiment of the present invention. Range 10 includes a cabinet 18, a door 20 closing an open end of a cooking cavity (not shown) and secured (e.g., by hinges) to cabinet 18, and a lower drawer 22. Range 10 further includes a backsplash 24 extending from cabinet 18.

As described hereinafter in more detail, mounting system 16, in one embodiment, includes a plurality of swing leaf springs 26 secured to rims 28 of cooktop 14 and supporting heating elements 12. Specifically, cooktop rims 28 extend from an underside surface 30 of cooktop 14 at the location of heating element openings 32 in cooktop 14, and each rim 28 substantially surrounds a respective opening 32. For each rim 28, springs 26 are secured approximately about one hundred and eighty degrees apart to rim 28 and support heating element 12.

Mounting system 16 can be utilized in many different model ranges and is not limited to use in any one particular range. Range 10 is illustrated here by way of example only. Ranges 10 are well known and are commercially available from General Electric Company, Appliance Park, Louisville, Ky. 40225.

Figure 2:
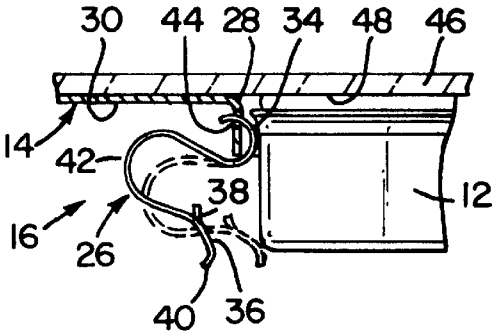
FIG. 2 is partial cross-sectional view through a portion of the range cooktop shown in FIG. 1 and illustrating a swing leaf spring, in accordance with one embodiment of the present invention, in the installation and initial contact positions.

FIG. 2 is partial cross-sectional view through a portion of range cooktop 14 shown in FIG. 1 and illustrating one of swing leaf springs 26 in an installation position (solid line) and an initial contact position (dotted line). Swing leaf spring 26 includes a spring hook portion 34 and a lead-in portion 36 having a spring barb 38 and an angular offset section 40. Spring 26 also includes an extension portion 42 which, in the illustrated embodiment, is substantially u-shaped. Spring hook portion 34 is sized to be inserted into, and at least partially extend through, a slot 44 in rim 28.

As shown in FIG. 2, a glass plate 46 is located over cooktop 30, and heating element 12 is forced against an underside surface 48 of plate 46. Preferably, the magnitude of the force between heating element 12 and plate 46 is approximately about fourteen pounds. Swing leaf springs 26, when engaged to heating element 12 as described below, forces element 12 upward and into contact with plate 46 with the desired amount of force and over a broad temperature range.

Swing leaf spring 26, in one embodiment, is fabricated from 0.025 inch thick spring steel. Although not shown, a slot in extension portion 42 may be provided, and the dimensions of the extension portion slot may be selected to adjust the force of spring 26 against heating element 12.

To install swing leaf spring 26, and still referring to FIG. 2, spring is positioned as shown in solid line so that spring hook 34 extends through slot 44. Spring 26 is then rotated, as shown in dotted line, so that offset section 40 contacts heating element 12.

Figure 3:
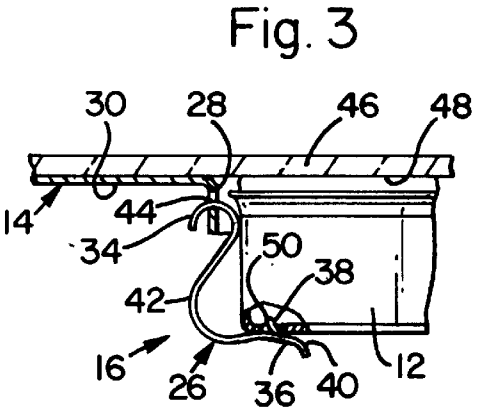
FIG. 3 illustrates the swing leaf spring, shown in FIG. 2, in the extended position.

As shown in FIG. 3, spring 26 is then snapped over heating element 12 so that barb 38 is inserted into a slot 50 in element 12. Barb 38 prevents separation of spring 26 from heating element 12. In this position, extension portion 42 of spring 26 is extended so that an upward force is imparted by spring 26 to heating element 12. In addition, and as shown in FIG. 3, spring hook portion 34 is in contact with heating element 12 and acts to dampen relative movement between heating element 12 and cooktop 14. Hook portion 34, however, does not necessarily have to be in contact with heating element 12. Hook portion 34 may be spaced from element 12, for example, so that cooling air can flow between hook portion 34 and element 12.

Figure 4:
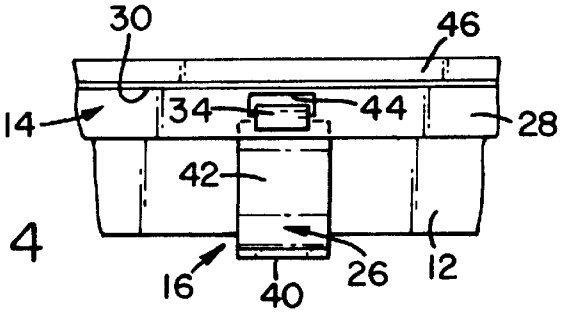
FIG. 4 is a side view of the swing leaf spring and heating element shown in FIG. 3.

As shown in FIG. 4, which is a side view of swing leaf spring 26 and heating element 12, spring 26 has a small width relative to the diameter of heating element 12. In addition, at least a section of spring hook portion 34 extends downward from slot 44 for a sufficient length to prevent undesired separation of spring 26 and rim 28.

Figure 5:
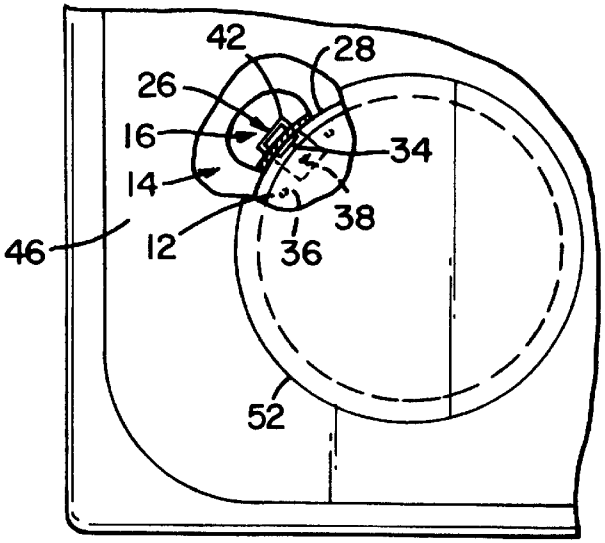
FIG. 5 is a top view, with components partially cut-away, of the swing leaf spring and heating element shown in FIG. 4.

FIG. 5 is a top view, with components partially cut-away, of glass plate 46, heating element 12, and swing leaf spring 26. Glass plate 46 includes a pattern 52 indicating the location at which pots and pans should be positioned on plate 46 for cooking. Although only one spring 26 is shown in FIG. 5, and as shown in connection with FIG. 1, two springs 26 support each heating element 12. In FIG. 5, hook portion 34 is spaced from an edge of heating element 12 so that cooling air can flow between hook portion 34 and element 12.

Mounting system including swing leaf springs 26 provides that heating elements 12 are forced against underside 48 of glass plate 46 with a desired force, e.g., fourteen pounds, over a wide range of operating temperatures. Specifically, as spring 26 is extended (see FIG. 3), the deflection force of spring increases. When spring 26 is positioned in the extended position shown in FIG. 3, spring 26 forces heating element 12 against underside 48 of plate 46. Further, by constructing spring 26 of 0.025 inches thick spring steel as described above, spring 26 will maintain heating element 12 against plate 46 with the desired force over a broad range of temperatures.

In addition, and with mounting system 16, the number of parts required to secure heating elements 12 to cooktop 14 is substantially reduced as compared to the number of parts required with at least one known mounting assembly. By reducing the number of parts, securing heating elements 12 is believed to be significantly simplified, which facilitates reducing the assembly time, and the fabrication costs of range 10 are believed to be reduced. Further, since swing leaf springs 26 may be secured to rims 28 and heating elements 12 without requiring the use of tools, the potential for scratching glass plate 46 is believed to be significantly reduced.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A range comprising:

a cooktop comprising at least one radiant heating element opening and a rim extending from an underside surface of said cooktop surrounding said radiant heating element opening, said cooktop rim comprising at least one slot;

a radiant heating element; and a mounting system comprising a swing leaf spring for engaging to said cooktop and to said radiant heating element for positioning said radiant heating element within said radiant heating element opening, said swing leaf spring comprising a spring hook portion at least partially inserted into said rim slot and a lead-in portion for engaging to said heating element.

2. A range in accordance with claim 1 wherein said lead-in portion comprises a spring barb for inserting into a slot in said heating element.

3. A range in accordance with claim 1 wherein said lead-in portion comprises an angular offset section for facilitating engagement between said spring and said heating element.

4. A range in accordance with claim 1 wherein said swing leaf spring comprises an extension portion.

5. A range in accordance with claim 4 wherein said extension portion is substantially u-shaped.

6. A range in accordance with claim 5 wherein said extension portion comprises slot.

7. A range in accordance with claim 1 further comprising a glass plate located over said cooktop, and said mounting system forces said heating element against an underside surface of said glass plate.

8. A range in accordance with claim 7 wherein a force between said heating element and said glass plate is approximately about fourteen pounds.

9. A range in accordance with claim 1 wherein said hook portion contacts said heating element for damping relative movement between said heating element and said cooktop.

10. A range comprising:

a cooktop comprising at least one radiant heating element opening and a rim extending from an underside surface of said cooktop surrounding said radiant heating element opening, said cooktop rim comprising a first slot and a second slot;

a glass plate located over said cooktop;

a radiant heating element; and a mounting system comprising a first swing leaf spring and a second swing leaf spring for engaging to said cooktop and to said radiant heating element for positioning said radiant heating element within said radiant heating element opening, said first swing leaf spring comprising a spring hook portion at least partially inserted into said first rim slot and a lead-in portion for engaging to said heating element, and said second swing leaf spring comprising a spring hook portion at least partially inserted into said second rim slot and a lead-in portion for engaging to said heating element.

11. A range in accordance with claim 10 wherein said first and second slots are located approximately about one hundred and eighty degrees apart in said rim.

12. A range in accordance with claim 10 wherein each said lead-in portions comprises a spring barb for inserting into a slot in said heating element.

13. A range in accordance with claim 12 wherein said lead-in portion comprises an angular offset section for facilitating engagement between said spring and said heating element.

14. A range in accordance with claim 10 wherein each said swing leaf spring comprises an extension portion.

15. A range in accordance with claim 10 wherein a force between said heating element and said glass plate is approximately about fourteen pounds.

16. A mounting system for securing a radiant heating element in a range including a cooktop having at least one radiant heating element opening and a rim extending from an underside surface of the cooktop surrounding the radiant heating element opening, said mounting system comprising at least one swing leaf spring for engaging to the cooktop and to the radiant heating element for positioning the radiant heating element within the radiant heating element opening, said swing leaf spring comprising a spring hook portion for being at least partially inserted into a slot in the cooktop rim and a lead-in portion for engaging to the heating element.

17. A mounting system in accordance with claim 16 wherein said swing leaf spring comprises an extension portion.

18. A mounting system in accordance with claim 16 wherein said lead-in portion comprises a spring barb for inserting into a slot in the heating element and an angular offset section for facilitating engagement between said spring and the heating element.

* * * * *